US011369251B2

(12) United States Patent
Roberson

(10) Patent No.: US 11,369,251 B2
(45) Date of Patent: Jun. 28, 2022

(54) PORTABLE DRYING MECHANISM

(71) Applicant: Aimee Suzanne Roberson, Coto de Caza, CA (US)

(72) Inventor: Aimee Suzanne Roberson, Coto de Caza, CA (US)

( * ) Notice: Subject to any disclaimer, the term of this patent is extended or adjusted under 35 U.S.C. 154(b) by 0 days.

(21) Appl. No.: 17/469,691

(22) Filed: Sep. 8, 2021

(65) Prior Publication Data

US 2022/0095886 A1 Mar. 31, 2022

Related U.S. Application Data

(60) Provisional application No. 63/083,322, filed on Sep. 25, 2020.

(51) Int. Cl.
*A47L 19/00* (2006.01)

(52) U.S. Cl.
CPC ..... *A47L 19/00* (2013.01)

(58) Field of Classification Search
CPC ... A47L 19/00; A46B 2200/3006; A46B 5/00; A46B 5/0095
See application file for complete search history.

(56) References Cited

U.S. PATENT DOCUMENTS 1,272,346 A 7/1918 Jefferies et al.
2,170,740 A * 8/1939 Volckening ..... A46B 5/00 15/104.9
2,214,684 A * 9/1940 Stinnett ..... A46B 5/00 15/164
3,574,952 A 4/1971 Lee, Jr.
4,689,897 A 9/1987 Marsalona
5,011,053 A 4/1991 Davies
5,117,565 A 6/1992 Willenbacher, Jr.
5,271,164 A 12/1993 Yoshimura et al.
5,491,863 A 2/1996 Dunn
5,604,993 A 2/1997 Auckerman
5,630,855 A 5/1997 Lundb ack
5,918,379 A 7/1999 Cooke
6,273,942 B1 8/2001 Jersby
6,663,309 B2 12/2003 Zamansky
(Continued)

OTHER PUBLICATIONS https://www.amazon.com/NUK-Bottle-Ergonomic-Discontinued-Manufacturer/dp/B00AWLZD40.

*Primary Examiner* — Shawn M Braden
(74) *Attorney, Agent, or Firm* — Camille A. Wilson; Wilson Dutra, PLLC

(57) ABSTRACT

The present disclosure provides for a portable drying mechanism. The mechanism may comprise a grip, shaft, neck, drying panels, and a tip. The shaft may comprise a button to modify the configuration of the portable drying mechanism. The button may release interchangeable components of the portable drying mechanism. The button may allow the shaft to extend. The button may activate an electrical or manual drying response such as, but not limited to, a water vacuum or rotating drying material. The shaft may comprise a hollow cavity for material retention. The shaft may comprise a telescoping aspect that allows for extension and retraction. The neck may comprise a flexible portion to dry containers with complex shapes. The tip may comprise a sensor to verify dryness within a container. The drying panels may comprise a predetermined shape and material that allow the drying panels to dry containers and hard-to-reach areas.

20 Claims, 18 Drawing Sheets

(56) References Cited

U.S. PATENT DOCUMENTS

| | | | | |
|---|---|---|---|---|
| 6,899,749 | B2 | 5/2005 | Johansson | |
| 6,978,507 | B2 | 12/2005 | Spaulding | |
| 7,017,222 | B2 | 3/2006 | Dunn | |
| 7,320,725 | B2 | 1/2008 | Arno et al. | |
| 7,473,046 | B2 | 1/2009 | Kraus et al. | |
| 7,770,723 | B2 | 8/2010 | Hajduk | |
| 7,895,768 | B2 | 3/2011 | Vossoughi et al. | |
| 8,336,156 | B1 | 12/2012 | Shimazu | |
| 8,793,892 | B2 | 8/2014 | McLoughlin | |
| D714,065 | S | 9/2014 | Chitayat et al. | |
| 8,935,858 | B2 | 1/2015 | Cloutier et al. | |
| 9,134,065 | B2 | 9/2015 | Hoffman-Lubitch | |
| 9,265,334 | B1 | 2/2016 | Fung-A-Wing | |
| 9,587,879 | B1 | 3/2017 | Mersinas | |
| 10,330,384 | B2 | 6/2019 | Leung et al. | |
| 10,531,725 | B2 * | 1/2020 | Birkert | A46B 5/0095 |
| 2002/0112301 | A1 * | 8/2002 | Lee | A46B 13/005 15/164 |
| 2006/0230629 | A1 | 10/2006 | Arno et al. | |
| 2007/0119011 | A1 | 5/2007 | Ho et al. | |
| 2012/0227278 | A1 | 9/2012 | Tretacosta | |
| 2012/0324752 | A1 | 12/2012 | Walls | |
| 2013/0192082 | A1 | 8/2013 | Young | |
| 2013/0305555 | A1 | 11/2013 | Spector | |
| 2014/0013529 | A1 | 1/2014 | Kilgore et al. | |
| 2014/0013610 | A1 | 1/2014 | Kilgore et al. | |
| 2014/0101961 | A1 | 4/2014 | Weber | |
| 2015/0374203 | A1 * | 12/2015 | Hirsh | A47L 15/502 220/488 |
| 2020/0305590 | A1 * | 10/2020 | Dunn | A46B 5/0095 |

* cited by examiner

200

200

837

836

839

PORTABLE DRYING MECHANISM

CROSS-REFERENCE TO RELATED APPLICATION

This application claims priority to and the full benefit of U.S. Provisional Patent Application Ser. No. 63/083,322 (filed Sep. 25, 2020, and titled "Hand Tool Used For The Purpose Of Drying Containers With Hard To Reach Areas"), the entire contents of which are incorporated herein by reference.

BACKGROUND

Given the proper conditions, bacteria, fungi, and viruses have the capacity to flourish in areas throughout the house, including portable containers or other confined areas. Some disease-causing bacteria, such as *Salmonella, E. coli*, and *Listeria* can cause illness if not properly cleaned and disinfected. The Centers for Disease Control and Prevention estimates that in the United States of America approximately 48 million people get sick from foodborne illness per year. Most of these illnesses are from infections caused by a variety of bacteria and viruses which can proliferate in an optimal environment.

The kitchen in particular can be a breeding ground for these issues. Many kitchen surfaces and accessories offer prime locations for bacterial growth. Dish towels, for example, are known conduits for bacterial growth, because these can provide nutrients and moisture for bacteria to grow. Bacteria can survive at least two days on surfaces, which is more than enough time to spread somewhere else if not disinfected. Kitchen countertops may have bacteria on them as well, which is why cleaning them before preparing food is highly recommended.

Due to germ, bacteria and scum concerns, some containers with residual standing water after washing are routinely hand dried. Using a dish towel, for example, can contribute to an increased exposure of bacteria when it is used to wipe up surfaces prior to drying the container, thereby potentially spreading bacteria as it is used from surface to surface. Furthermore, not completely drying containers can also lead to a buildup of scum and residue.

If left untreated, fungus can also appear and grow in containers in the form of mold. If presented with some of the conditions noted above, such as water, warmth, and a dark space, fungus can start to appear as soon as 48 hours if the container was not properly cleaned and dried.

Many containers have restricted access to the full interior due to narrow necks, depth, width, or odd shape of the container, among other attributes. This makes it very difficult to get a container completely dry using traditional methods. Some examples of current methods to dry these kinds of containers may include air drying by using a peg or drying rack system, or by inserting paper towels or cloth towels into the container, which risks exposure to bacteria if those items aren't clean and dry before use. Some people try to navigate the container by guiding a paper towel or cloth towel with another long narrow utensil, to hopefully reach the small amounts of liquid still left on the sides and bottom of the container. Homemade attempts of guiding towels into containers for thorough drying is often cumbersome, ineffective, and frustrating, especially for glass containers as these methods often leave streaks or lint on the surface, depending on the material used for drying. Water spots may also be left behind, as well, reducing the aesthetic appeal of the container.

Other devices such as pegboards and drying racks take up precious wall and countertop space. Properly air drying can take up to 48 hours. Meanwhile, using dirty dish towels to dry containers potentially introduces bacteria into food and beverage containers.

For some reusable containers, such as water bottles or insulated food containers, people often use a brush with soap and water to scrub and clean the inside of the container. Anyone cleaning the container still has a potential limitation of not being able to see whether they cleaned the entire interior surface properly, including nooks and crannies. Undetected residual liquid or food leaves the container vulnerable to bacterial growth, as an example. Effective and efficient drying in hard-to-reach areas is near impossible with current methods.

SUMMARY OF THE DISCLOSURE

What is needed is a portable drying mechanism that may remove residual liquid within containers and hard-to-reach areas. Accordingly, the present disclosure provides for a portable drying mechanism. In some embodiments, the mechanism may comprise a grip, shaft, neck, drying panels, and tip. The shaft may comprise one or multiple pieces, wherein the length may be extended or compressed to accommodate containers of different heights or lengths. In some implementations, the grip may comprise a button or other activation mechanism, such as a switch or rip cord, to modify the configuration of the portable drying mechanism.

In some aspects, a portable drying mechanism may be reused for a limited number of uses and discarded, or may be used long-term when properly maintained after each use, depending on the material. In some implementations, a button may release interchangeable components of the portable drying mechanism. In some embodiments, the button may allow the shaft to extend. In some implementations, the button may activate an electrical drying response such as, but not limited to, a water vacuum, or rotating drying material. In some aspects, the shaft may comprise a hollow cavity for material retention.

In some embodiments, the shaft may comprise a telescoping aspect that allows for extension and retraction. In some embodiments, extenders may be attached to achieve a desired length. In some implementations, the shaft may comprise a flexible portion to dry containers with complex shapes. In some aspects, the neck may comprise a drying material that protrudes at a predetermined distance from the portable drying mechanism. In some embodiments, the tip may comprise a sensor to verify dryness within a dried container.

In some implementations, the portable drying mechanism may comprise components that may allow the portable drying mechanism to access limited geometry within containers. In some embodiments, the portable drying mechanism may provide sensory feedback to indicate the internal state of the container where stringent drying is imperative such as in a scientific setting. In some aspects, the portable drying mechanism may comprise components that may be sterilized for use in laboratories or medical settings, such as in the hospital.

The present disclosure relates to a portable drying mechanism that may include a grip configured to allow for gripping by a hand, where the grip may comprise a first grip end and a second grip end; a shaft may comprise a first shaft end and a second shaft end, where the first shaft end may be couplable to the second grip end; a neck may comprise: a first neck end, where the first neck end may be couplable to the second shaft end, a second neck end, and a plurality of drying panels configured to extend from the second neck end; a tip may comprise a first tip end and a second tip end, where the first tip end may be couplable to the second neck end; and an attachment mechanism configured to couple the neck to one or both the second neck end and the first tip end.

In some embodiments, the plurality of drying panels may comprise a synthetic material. In some implementations, the plurality of drying panels may comprise a natural material. In some aspects, the attachment mechanism may comprise one or more of a threaded connection, a bayonet coupling, a snap-in-place mechanism, a sliding mechanism, ball and joint mechanism, and a button mechanism. In some aspects, the shaft may be flexible. In some embodiments, a length of the shaft may be adjustable. In some implementations, the shaft may comprise a telescoping mechanism.

In some aspects, the shaft may comprise multiple pieces that integrate to extend or compress a length of the shaft incrementally. In some embodiments, the second tip end may comprise a sensor. In some implementations, one or more of the grip, shaft, neck, and tip are hollow. In some aspects, the plurality of drying panels may be replaceable. In some embodiments, the plurality of drying panels may be retractable. In some implementations, the plurality of drying panels may be reusable. In some aspects, the neck may comprise a flexible portion configured to allow the shaft to bend.

In some embodiments, the plurality of drying panels may be flexible. In some implementations, the shaft may be interchangeable. In some aspects, the rotation of the plurality of drying panels may be configured to be automated or manually manipulated. In some embodiments, the portable drying mechanism may comprise a release mechanism configured to release the attachment mechanism. In some implementations, the portable drying mechanism may be wholly or partly reusable. In some aspects, the plurality of drying panels may be detachable and replaceable.

BRIEF DESCRIPTION OF THE DRAWINGS

The accompanying drawings that are incorporated in and constitute a part of this specification illustrate several embodiments of the disclosure and, together with the description, serve to explain the principles of the disclosure.

DETAILED DESCRIPTION

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Drying mechanism: as used herein refers to a drying tool comprising a grip, elongated shaft and neck with detachable drying panels and tip, wherein the drying mechanism may be used to dry the interior of a container or other hard-to-reach areas. In some embodiments, the mechanism may comprise a plurality of components that may be either detachable, replaceable and or reusable. In some aspects, the drying mechanism may comprise disposable drying heads, wherein each may be used for one or more drying solutions in a plurality of containers.

Container: as used herein refers to a vessel that may comprise an enclosed or partially enclosed surface area that may collect or retain liquid or moisture. In some aspects, liquid and other non-limiting fluids may be absorbed by a drying mechanism. In some embodiments, the container may hold one or more liquids within its dimensions. As illustrative examples, a container may comprise a decanter, champagne flute, water bottle, vase, test tube, beaker, or carafe.

Figure 1:
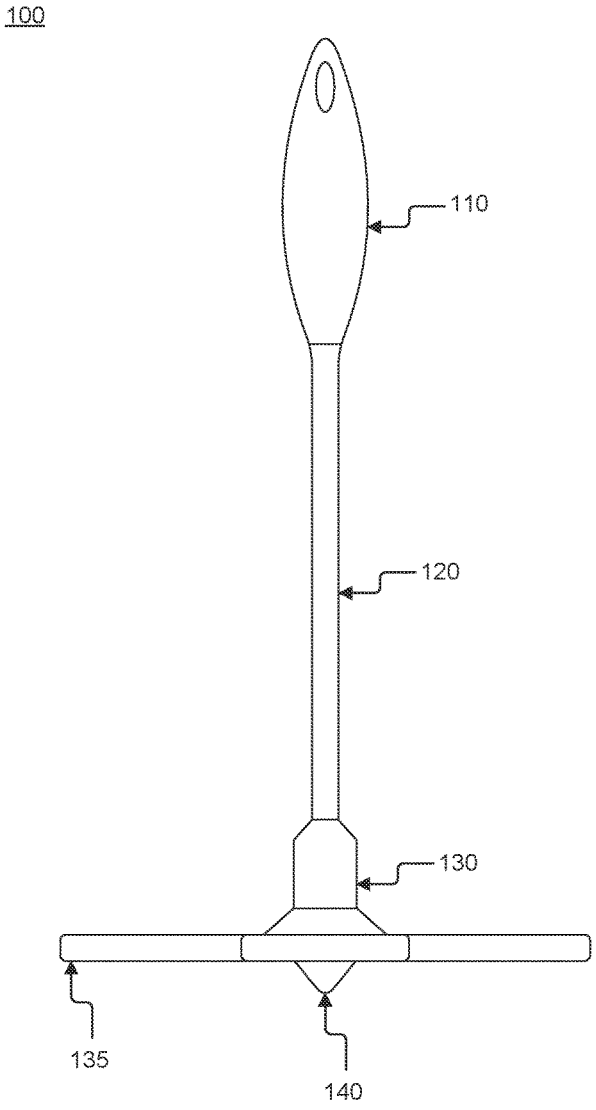
FIG. 1 illustrates an exemplary drying mechanism, according to some embodiments of the present disclosure.

Referring now to FIG. 1, an exemplary drying mechanism 100 is illustrated. In some embodiments, the drying mechanism 100 may comprise a grip 110. In some implementations, the drying mechanism may comprise a shaft 120. In some aspects, the shaft 120 may comprise an attachment mechanism that allows the shaft 120 to connect to a neck 130. In some embodiments, the neck 130 may comprise a tip 140. In some implementations, the neck 130 may comprise a plurality of drying panels 135. In some embodiments, the drying panels 135 may be flexible to dry unique internal contours of containers or confined spaces.

In some implementations, the drying mechanism 100 may comprise a singular piece, wherein all components are attached. In some aspects, the drying mechanism 100 may comprise individual pieces, wherein each component may be separated from the drying mechanism 100. For example, the grip 110 may disconnect from the shaft 120 and be reattached after being cleaned or serviced. Additionally, the shaft 120 may comprise one or several individual pieces that integrate to allow for extension and compression of the length of the shaft 120. This may allow the drying mechanism 100 to be used on containers of all different sizes and shapes. In some embodiments, at least a portion of the shaft may be flexible, which may allow for more comprehensive reach and access to spaces within a container.

In some embodiments, the plurality of drying panels 135 may be removable from the drying mechanism 100. In some implementations, the plurality of drying panels 135 may comprise one material or several materials, arranged randomly or in a pattern. In some aspects, the plurality of drying panels 135 may comprise a wholly flexible or partly flexible material. For example, the plurality of drying panels 135 may comprise a base material and a topical, textured material further comprising flexible or rigid bumps, grooves, points, or other non-limiting textures. This may aid in the effective drying of the target container, especially one having a particularly intricate configuration. In some implementations, the plurality of drying panels 135 may be reused for a limited number of uses and discarded or may be used long-term when properly maintained after each use, depending on the material.

Figure 2A:
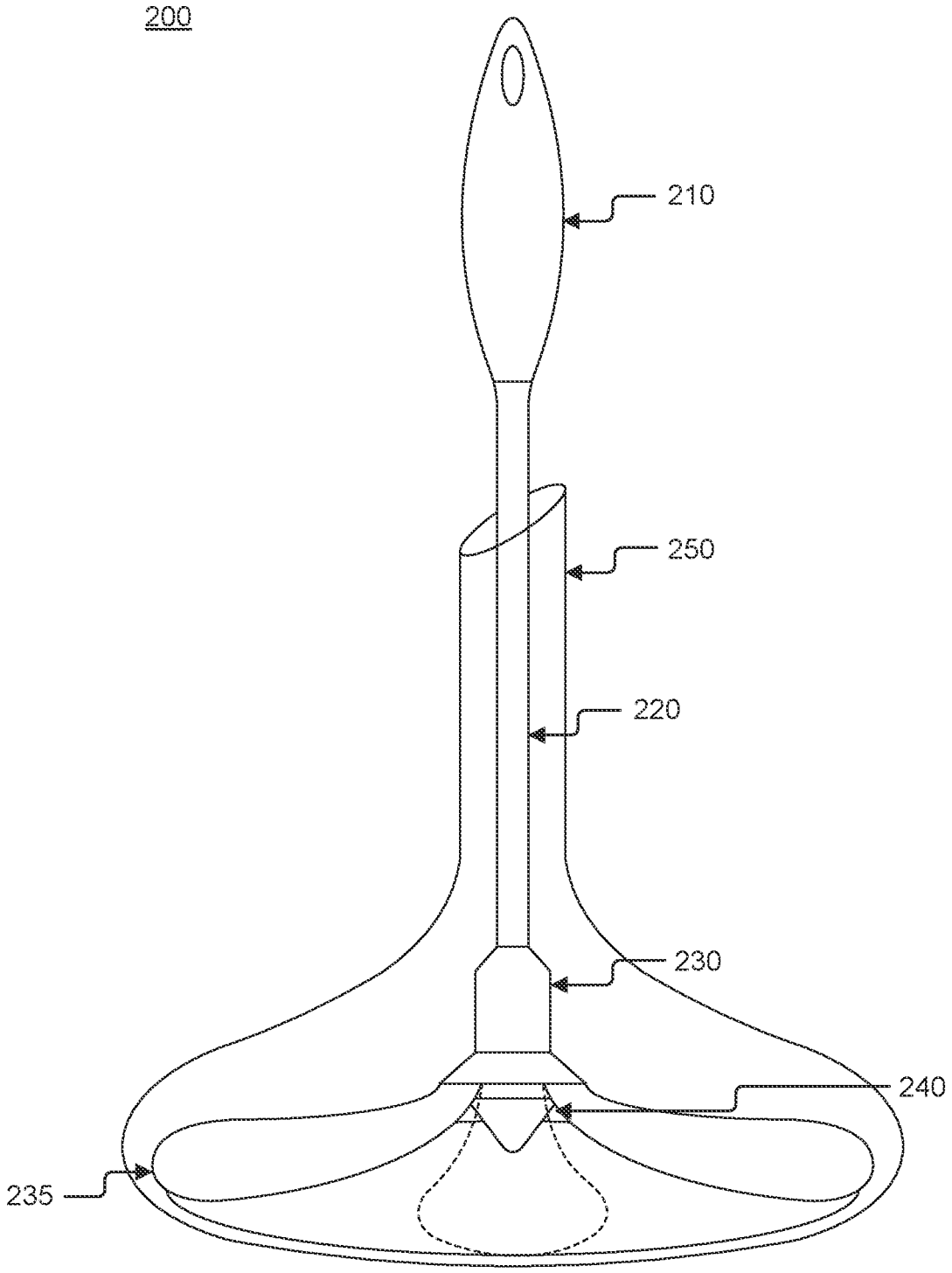
FIG. 2A illustrates an exemplary drying mechanism and a container, according to some embodiments of the present disclosure.
Figure 2C:
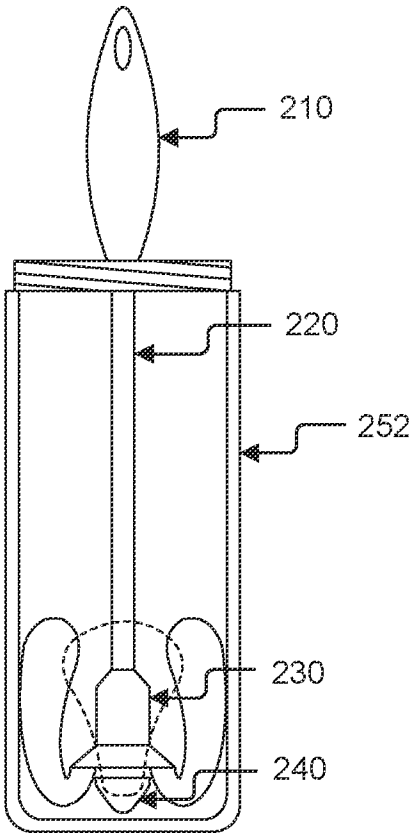
FIG. 2C illustrates an exemplary drying mechanism and a container, according to some embodiments of the present disclosure.
Figure 2B:
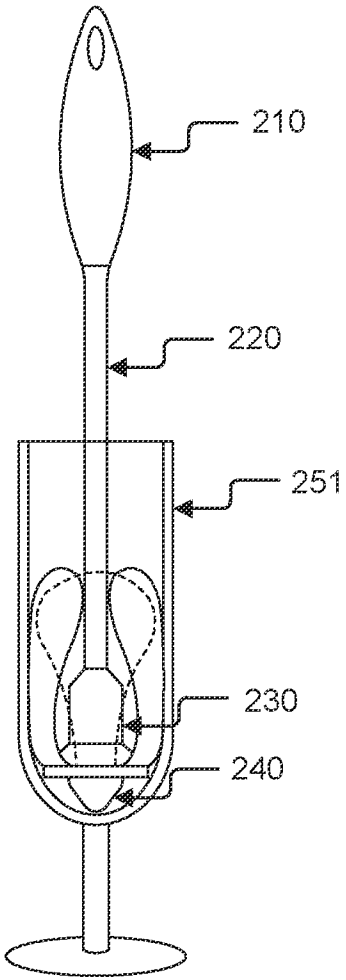
FIG. 2B illustrates an exemplary drying mechanism and a container, according to some embodiments of the present disclosure.

Referring now to FIGS. 2A-C, an exemplary drying mechanism 200 and a container 250, 251, 252 is illustrated. In some embodiments, the neck 230 of the drying mechanism 200 may extend to the distal end of the interior of the container 250, 251, 252. In some implementations, the shaft 220 may extend into an opening of a container 250, 251, 252 to allow the tip 240 and the drying panels 235 to reach the edges within the container 250, 251, 252.

In some aspects, the neck 230 may comprise a plurality of drying panels 235. In some embodiments, the drying panels 235 may be flexible to dry unique internal contours of containers. In some aspects, the drying panels 235 may comprise one or more materials, whereby liquid may be absorbed, wholly or in part, into the drying panels 235.

In some implementations, the tip 240 may assist the drying mechanism 200 in removing liquid from the corners of a plurality of shapes. As an example, the tip 240 may remove small amounts of water in the distal corners of a decanter after the decanter has been washed. The tip 240 may guide the drying panels 235 within a container, allowing for more precise drying. In some embodiments, the neck 230 may comprise flexible material, wherein the drying mechanism 200 may be inserted into more than one shape container.

For example, a container 250, 251, 252 may comprise a smaller opening and a wider enclosure like a water bottle or a baby bottle, wherein a drying mechanism 200 may be inserted and freely move around to absorb liquid within the container. In some aspects, the drying mechanism 200 may remove liquid from generic container types such as plastic containers, narrow-necked water bottles, baby bottles, wine glasses, and laboratory test beakers, as a non-limiting list. As another example, a decanter neck may be easily dried by a drying mechanism 200 with a thinner shaft 220, wherein the drying mechanism 200 may also reach the base of the interior of the container.

In some embodiments, the shaft 220 may comprise a plurality of interchangeable lengths, wherein the drying mechanism 200 may reach into one or more container 250, 251, 252 bases. The plurality of interchangeable lengths may be incremental, such as through a telescoping mechanism, or freely adjustable. In some implementations, the drying mechanism 200 may interface with shafts 220 of a plurality of predetermined lengths to fit a plurality of containers 250, 251, 252. In some aspects, the shaft 220 may comprise a variable thickness to comprise a plurality of lengths on the same shaft 220. A variable thickness may allow the shaft 220 to access narrow openings that are shallow enough to require only the first portion of the shaft 220 to enter the container 251 while simultaneously providing a thicker shaft closer to the neck to provide increased stability during use. The thickness of the shaft 220 may be uniformly predetermined, tapered, adjustable, or any combination thereof.

In some implementations, the shaft 220 and neck 230 may be removed from the tip 240. In some implementations, the shaft 220 may comprise locking mechanisms on its ends, wherein the grip 210, neck 230, and tip 240 may connect.

As a non-limiting example, the drying mechanism 200 may comprise a smaller width shaft 220 wherein, the drying mechanism 200 may be placed into the opening of a champagne flute. A wider version of the shaft 220 may be used for a deeper container, such as a flower vase, where a sturdier shaft 220 may be needed, and the depth of the container is longer. In between uses, a user may disconnect and reconnect one or more shafts 220 to coincide with the container being dried by the drying mechanism 200.

Figure 3A:
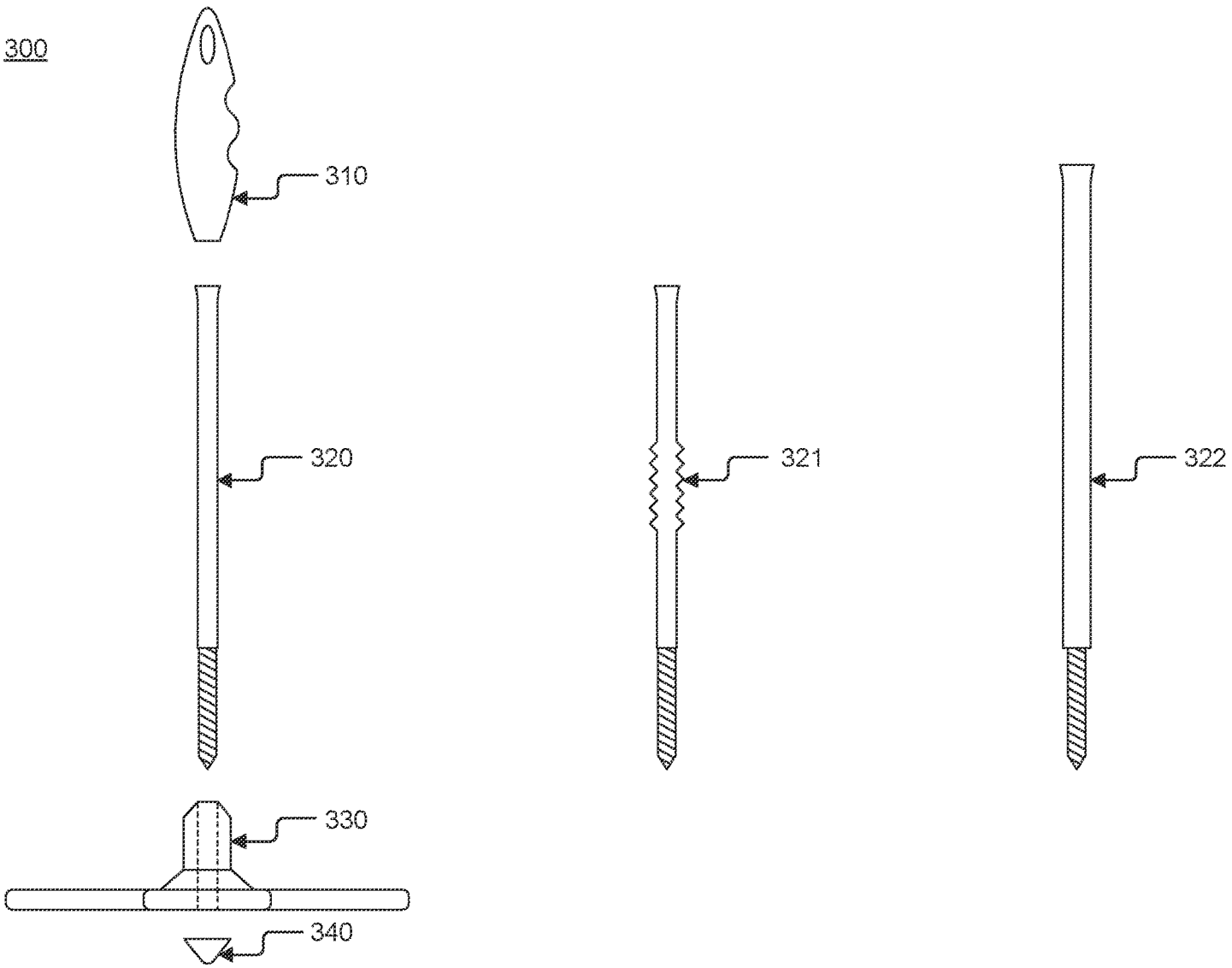
FIG. 3A illustrates an exemplary drying mechanism and a plurality of shafts, according to some embodiments of the present disclosure.
Figure 3B:
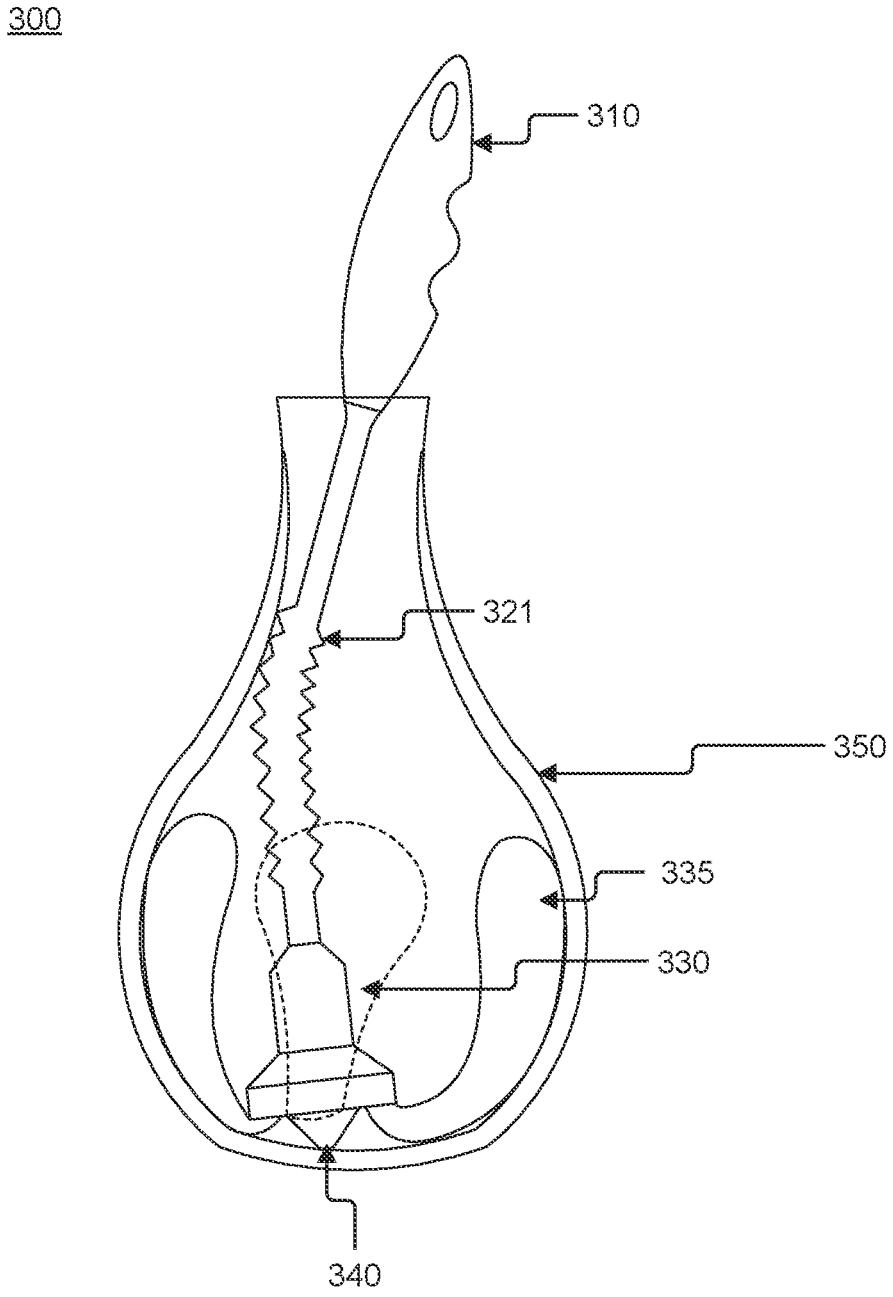
FIG. 3B illustrates an exemplary drying mechanism and a container, according to some embodiments of the present disclosure.

Referring now to FIGS. 3A-B, an exemplary drying mechanism 300 and a plurality of shafts 320, 321, 322 is illustrated. In some embodiments, the grip 310 may interface with a plurality of shafts 320, 321, 322. In some implementations, the shaft may attach to the neck 330 via a threaded hole. In some aspects, the tip 340 may be detachable from the neck 330. In some implementations, the tip 340 may incorporate a non-scratching connection piece, such as rubber or silicone, as non-limiting examples. In some embodiments, the neck 330 may comprise a locking mechanism, wherein the neck 330 may be fastened to the shafts 320, 321, 322 with or without a tip.

For example, the neck 330 may comprise two connectors that may couple to one another and fixate the neck 330 to the drying mechanism 300. In some implementations, the shaft 321 may comprise an extension system, wherein the length of the drying mechanism 300 may be adjusted. In some aspects, the orientation of the shaft 321 may be adjustable.

For example, a container 350 may comprise significant curvature. The shaft 321 may comprise a flexible portion that allows the neck 330 to match the curvature of the container 350 body so that the drying panels 335 can reach and dry the curve of the container 350. In some aspects, the neck 330 may comprise a plurality of drying panels 335. In some embodiments, the drying panels 335 may be flexible to dry unique internal contours of containers. The drying panels 335 may come in one or more shapes and sizes. In some aspects, the drying mechanism 300 may comprise a plurality of interchangeable shafts 320, 321, 322.

In some embodiments, the shaft 320, 322 may comprise a plurality of lengths and widths. In some aspects, a longer shaft 322 may be used to reach a plurality of depths of containers. In some embodiments, a thicker shaft 322 may be used for heavy-duty containers, whereby the drying mechanism 300 may remain intact.

For example, a thinner shaft 320 may comprise a lower structural integrity that may inhibit the application of a large amount of force that may be necessary to maneuver the drying mechanism 300 within the container 350. A thicker shaft 322 may provide the drying mechanism 300 with sufficient structural integrity for more strenuous use. In some embodiments, the neck 330 may comprise one or more sizes, wherein one or more sized shafts 320, 321, 322 may adapt into the neck 330.

Figure 4:
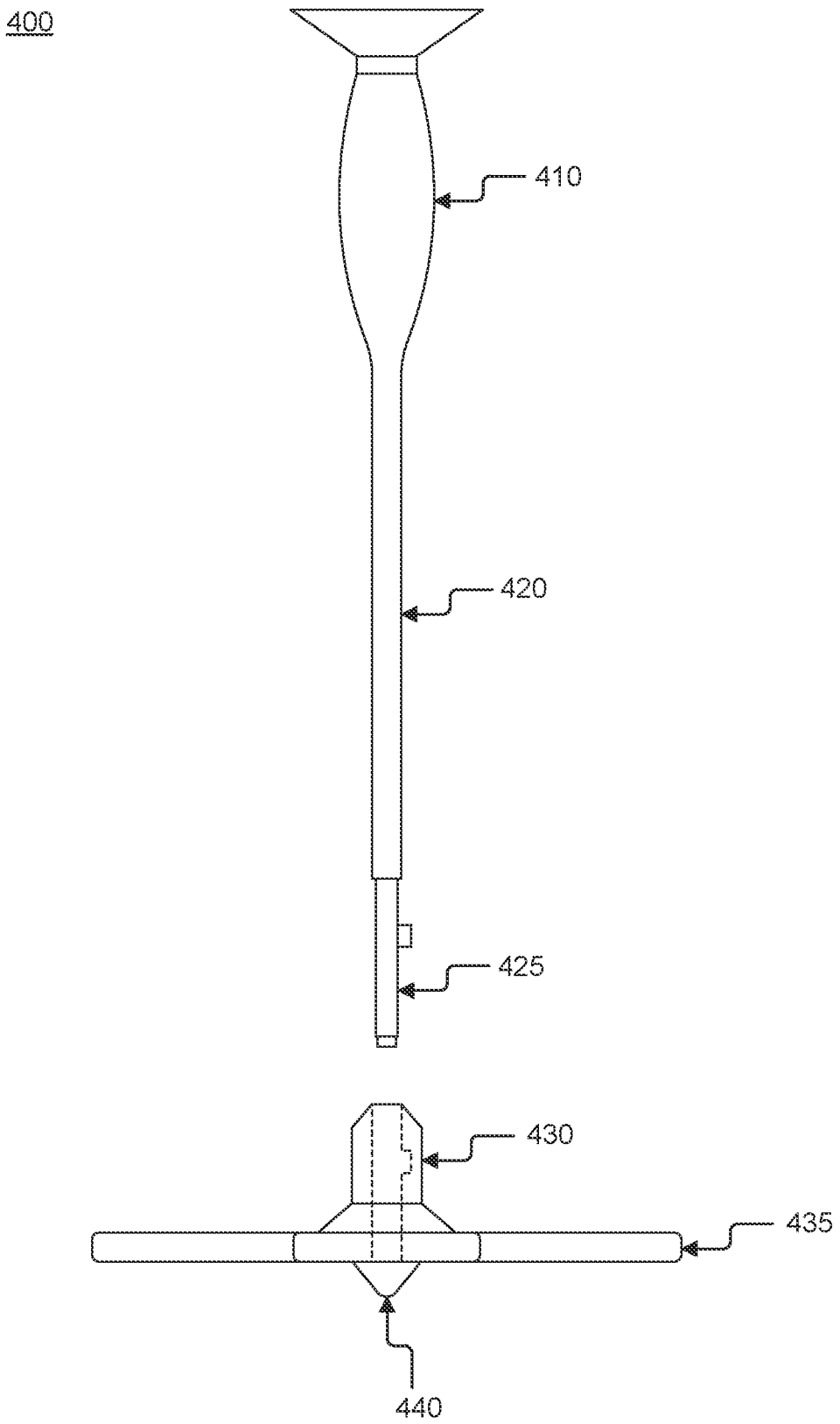
FIG. 4 illustrates an exemplary drying mechanism, according to some embodiments of the present disclosure.

Referring now to FIG. 4, an exemplary drying mechanism 400 with detachable neck 430 is illustrated. In some embodiments, the drying mechanism 400 may comprise a grip 410. In some aspects, the grip 410 may comprise a storage method that may interface with an external surface such as a suction cup, as a non-limiting example. The storage method may allow the user to place the drying mechanism 400 in a proximal location to an area of frequent use.

In some implementations, the drying mechanism 400 may comprise a shaft 420. In some aspects, the grip 410 and the shaft 420 may be regions of a single component. In some embodiments, the shaft 420 may connect to the detachable neck 430 via an attachment mechanism 425. In some implementations, the neck 430 may comprise a tip 440. In some aspects, the plurality of drying panels 435 may detach from the neck 430.

In some embodiments, the tip 440 may comprise an absorbent material, wherein the drying mechanism 400 may absorb liquid in the corners of containers. In some embodiments, the flexible drying panels 435 may comprise a material that may retain fluid as the flexible drying panels are compressed when removed from a container.

For example, the attachment mechanism 425 may be used on a smaller drying mechanism 400, then removed and attached to larger drying mechanism 400 for a plurality of interchangeable uses. In some embodiments, the attachment mechanism 425 may comprise a slot, wherein a spring-loaded button may be inserted. In some implementations, the button may be pressed to remove the attachment mechanism 425 from the drying mechanism 400. In some aspects, the button may improve the accessibility of interchanging parts, including fresh drying heads, between drying mechanisms 400.

In some embodiments, the drying mechanism 400 may comprise slots on any part of its outer surface. In some aspects, the drying mechanism 400 may comprise a plurality of slots, wherein the neck 430 may attach at one or more lengths. In some embodiments, two or more slots may be located on the side of the drying mechanism 400. In some implementations, the drying mechanism 400 may comprise a plurality of grooves, wherein the neck 430 may attach at one or more lengths by sliding and locking into one or more grooves, such as for a bayonet coupling, as a non-limiting example.

Referring now to FIGS. 5A-E, an exemplary drying mechanism 500 is illustrated. In some embodiments, the drying mechanism 500 may comprise a grip 510. In some aspects, the grip 510 may comprise an opening for attachment to an external component. In some embodiments, the shaft 520 may connect to the neck 530 via an attachment mechanism 525. In some implementations, the neck 530 may comprise a tip 540.

In some aspects, the neck 530 may comprise a plurality of drying panels 535. The plurality of drying panels 535 may be uniform or varied, comprising different sizes, shapes, and textures. For example, the plurality of drying panels 535 may comprise two or more flexible materials, so as to wipe dry glass containers. In some embodiments, the drying panels 535 may be flexible to dry unique internal contours of containers. In some implementations, the flexibility of the drying panels 535 may increase as the drying panels 535 absorb liquid. In some embodiments, the drying panels 535 may retain fluid when compressed, allowing for more effective drying with limited risk of inadvertently adding liquid back into a container when removing the drying mechanism 500. In some aspects, compression may occur if the neck of the container is small and the drying panels 535 may fold to fit through the opening.

In some implementations, the drying mechanism 500 may comprise a shaft 520. In some aspects, the shaft 520 may comprise a telescoping mechanism 515, wherein the drying mechanism 500 may be adjusted to a plurality of lengths. In some embodiments, the shaft 520 may comprise one or more telescoping mechanisms 515. In some implementations, the telescoping mechanisms 515 may comprise a plurality of lengths, that allow the drying mechanism 500 to reach different regions of a container or different sized container.

Figure 5A:
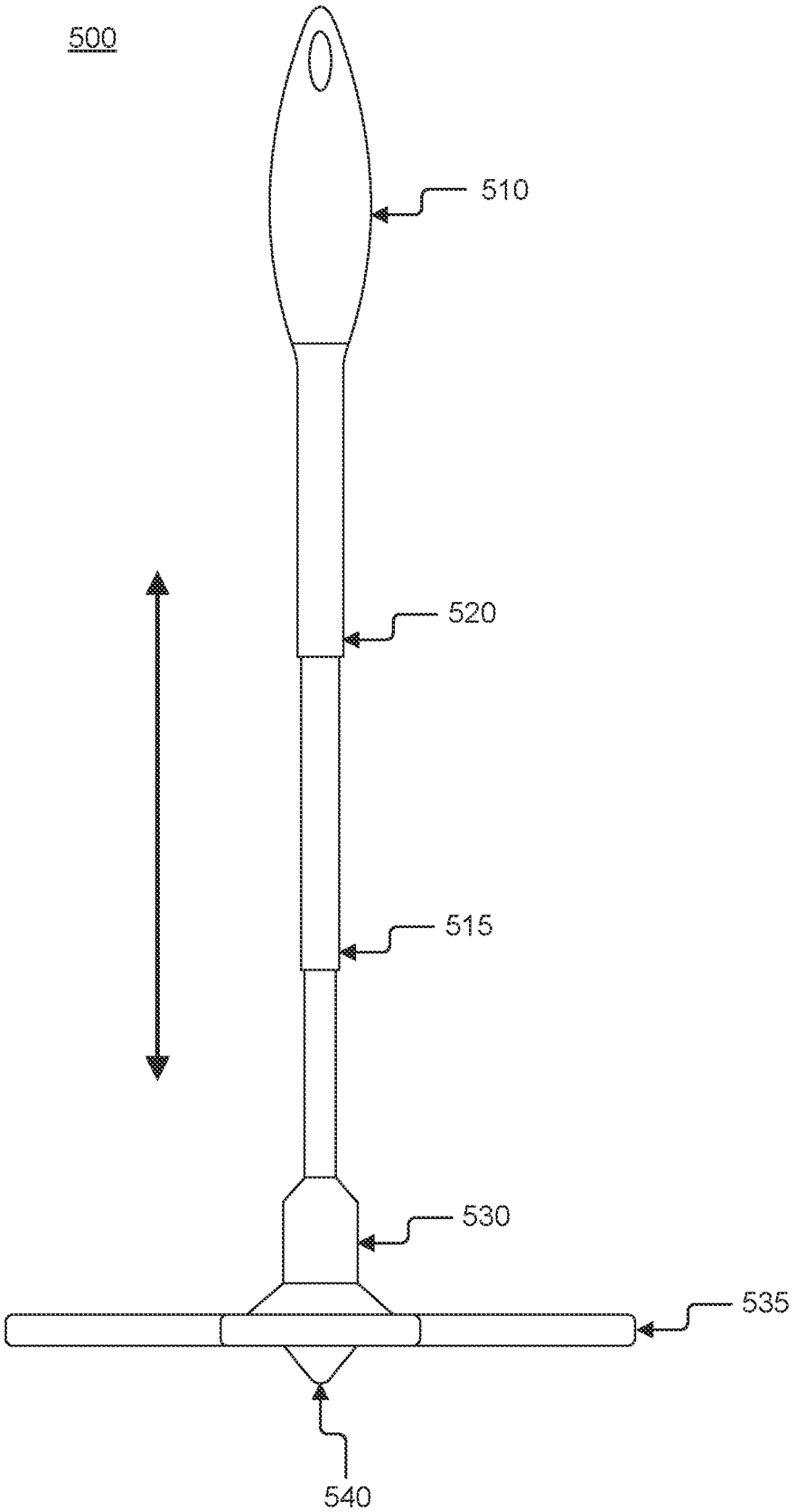
FIG. 5A illustrates an exemplary drying mechanism, according to some embodiments of the present disclosure.
Figure 5B:
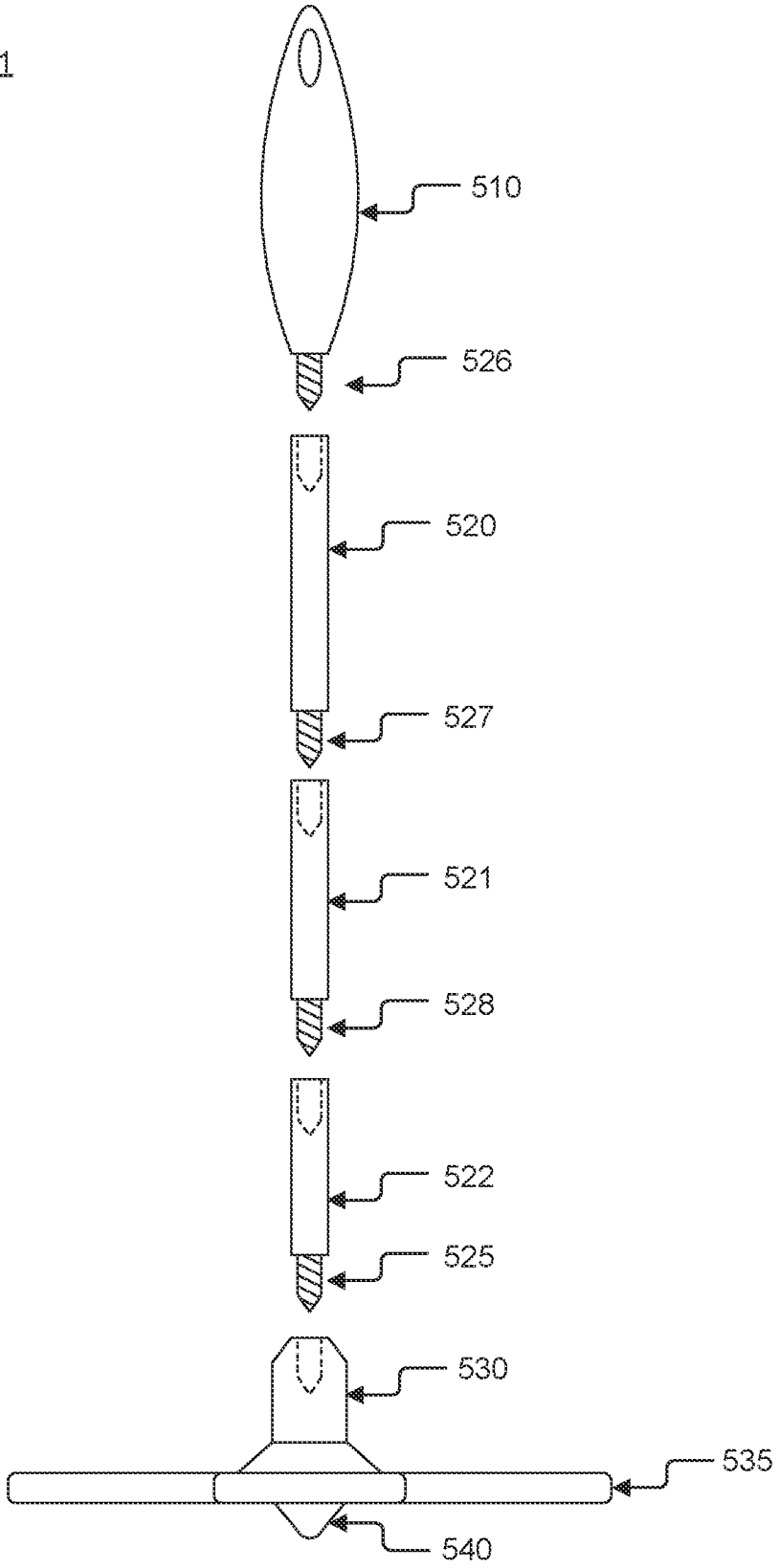
FIG. 5B illustrates an exemplary drying mechanism, according to some embodiments of the present disclosure.
Figure 5E:
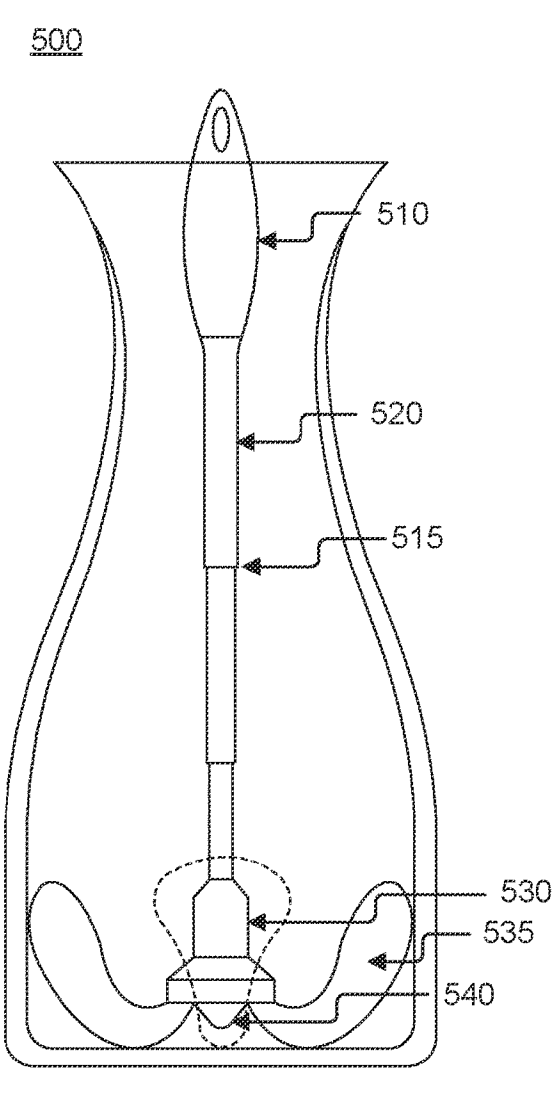
FIG. 5E illustrates an exemplary drying mechanism, according to some embodiments of the present disclosure.
Figure 5D:
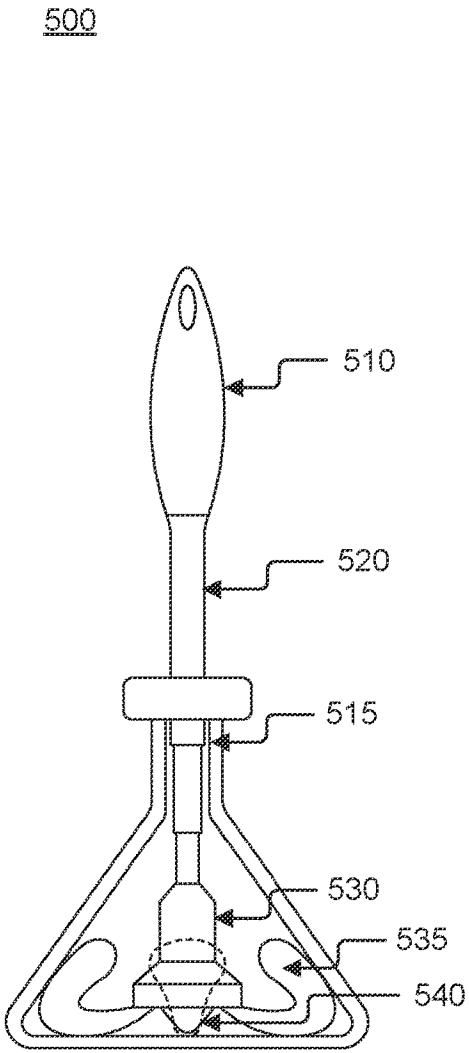
FIG. 5D illustrates an exemplary drying mechanism, according to some embodiments of the present disclosure.
Figure 5C:
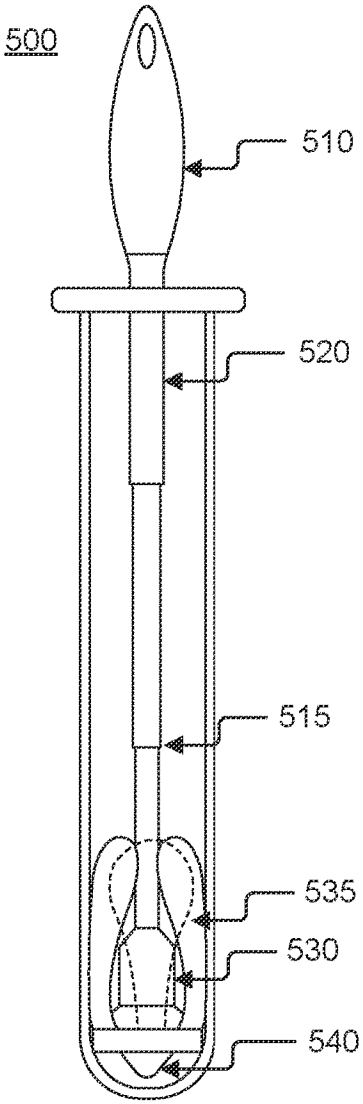
FIG. 5C illustrates an exemplary drying mechanism, according to some embodiments of the present disclosure.

In some aspects, such as illustrated in FIG. 5B, the shaft 520, 521, 522 may comprise one or more predetermined lengths that may be interchangeable to accommodate for containers of a plurality of depths, each comprising their own attachment mechanism 525, 526, 527, 528. For example, the shaft 520, 521, 522 may comprise three shafts 520, 521, 522 to reach the bottom of a carafe and then the user may remove one or more shafts 521, 522 to use the drying mechanism 500 for a shallow test beaker.

The plurality of lengths may be predetermined or freely customizable by the user. In some aspects, the shaft 520 may comprise locking mechanisms 525, 526, 527, 528 that allow for locking of the different lengths. In some aspects, the locking mechanism may be activated by twisting the shaft 520. For example, the shaft 520 may be twisted clockwise to tighten the locking mechanism, whereas twisting the shaft 520 counterclockwise may loosen the locking mechanism.

Figure 6B:
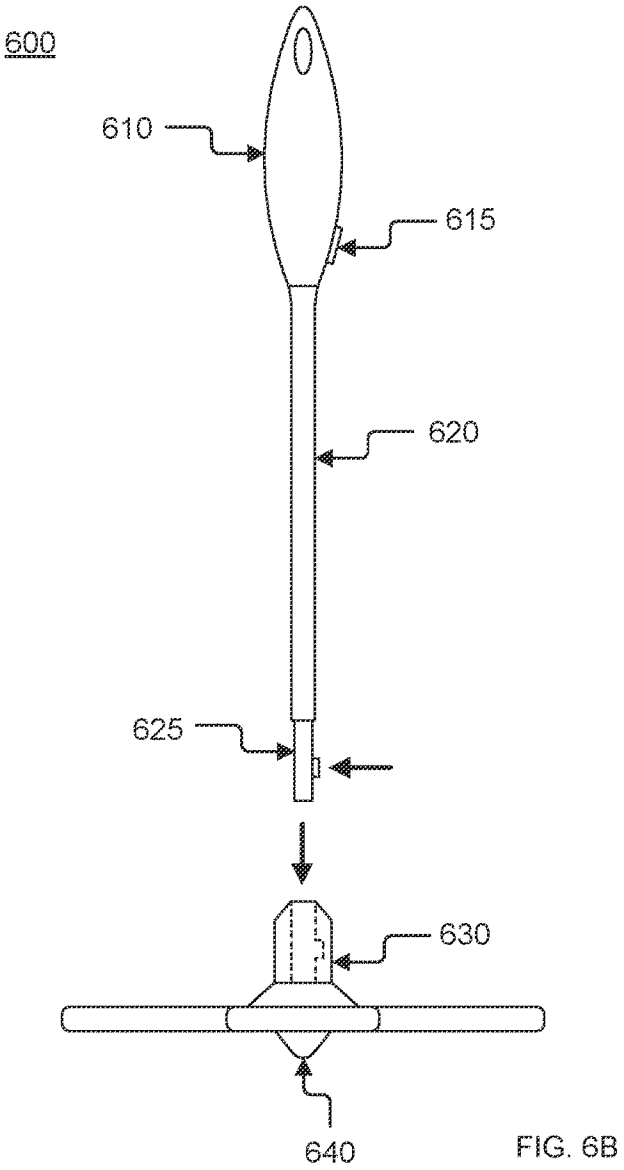
FIG. 6B illustrates an exemplary drying mechanism comprising an attachment mechanism, according to some embodiments of the present disclosure.
Figure 6A:
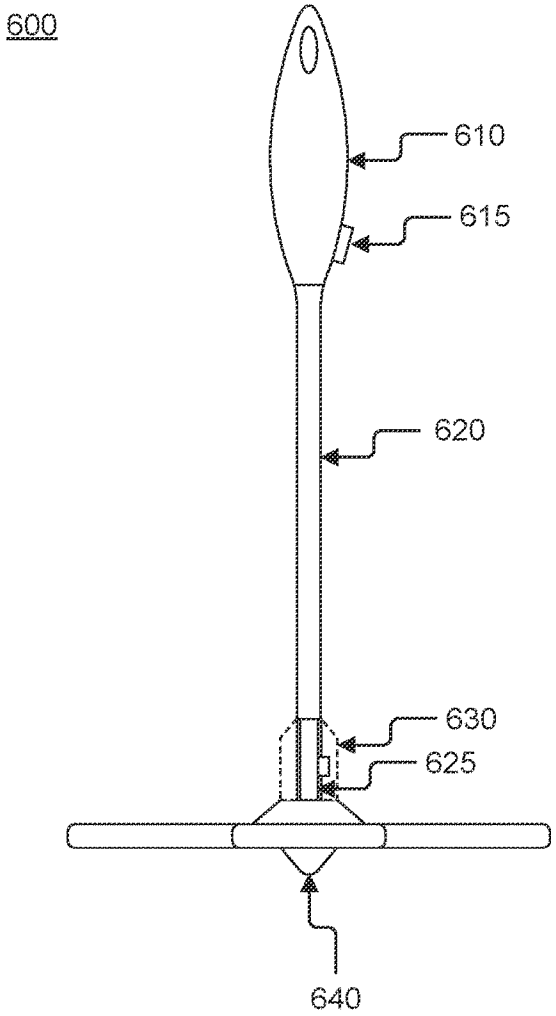
FIG. 6A illustrates an exemplary drying mechanism comprising an attachment mechanism, according to some embodiments of the present disclosure.

Referring now to FIGS. 6A-B, an exemplary drying mechanism 600 comprising an attachment mechanism 625 is illustrated. In some embodiments, the drying mechanism 600 may comprise a grip 610. In some implementations, the drying mechanism 600 may comprise a shaft 620 coupled to the grip 610. In some embodiments, the shaft 620 may connect to the neck 630 via an attachment mechanism 625. In some aspects, the attachment mechanism 625 may be actuated by a release mechanism 615. In some implementations, the neck 630 may comprise a tip 640.

In some aspects, the grip 610 may comprise a release mechanism 615, wherein the neck 630 may be removed from the drying mechanism 600. The release mechanism 615 may comprise a button or sliding channel, as non-limiting examples. In some implementations, pressing on the button may allow for the attachment and disconnection of the neck 630 from the drying mechanism 600. In some embodiments, the shaft 620 may be interchanged on the drying mechanism 600. In some implementations, a larger shaft 620 may be attached to the drying mechanism 600, wherein a more durable version of the drying mechanism 600 may be used.

In some implementations, the attachment mechanism 625 may allow portions of the drying mechanism 600 to be interchangeable with other drying mechanisms 600. For example, the attachment mechanism 625 may attach a neck 630 to a smaller drying mechanism 600, then removed and attached to larger drying mechanism 600 for a plurality of uses.

Figure 7B:
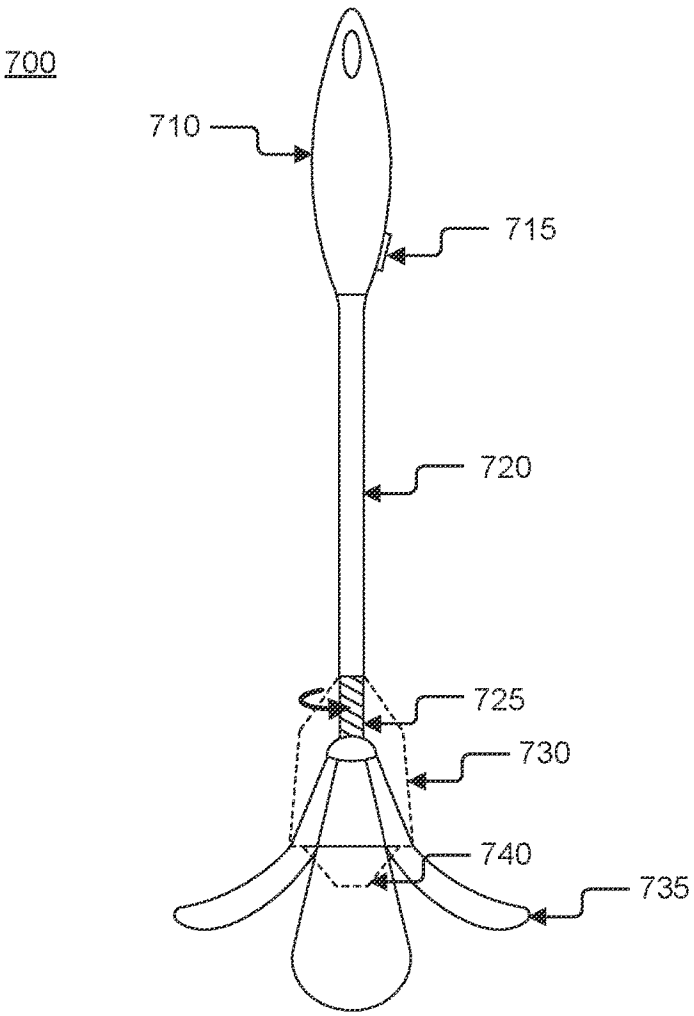
FIG. 7B illustrates an exemplary drying mechanism, according to some embodiments of the present disclosure.
Figure 7A:
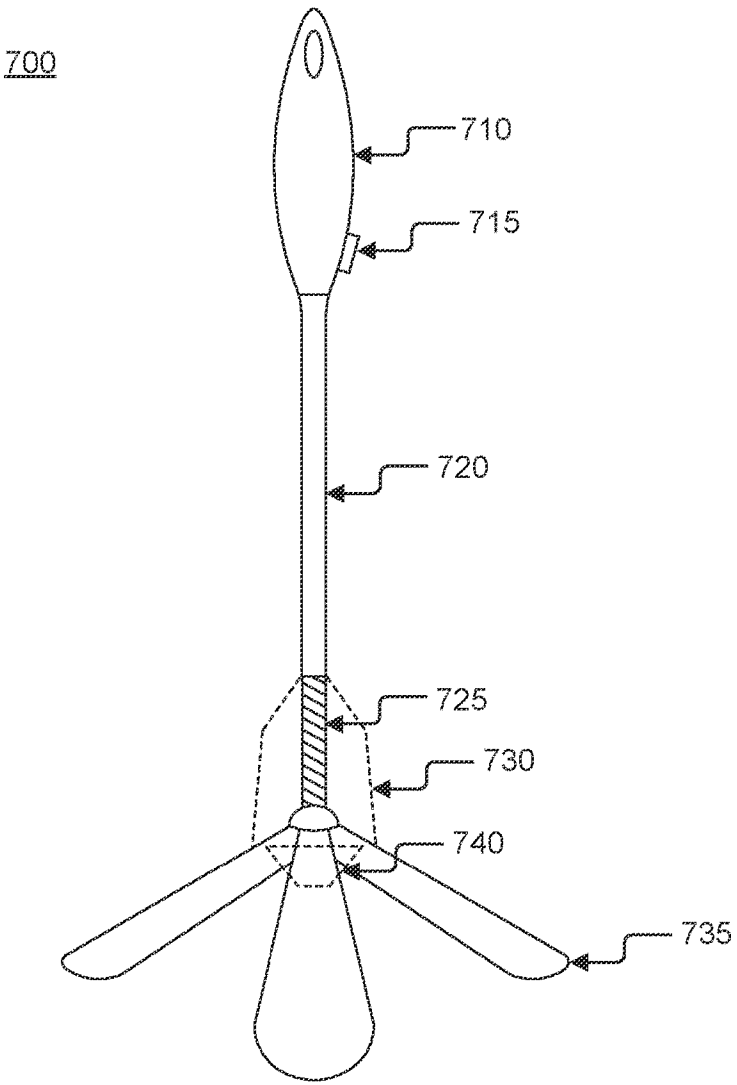
FIG. 7A illustrates an exemplary drying mechanism, according to some embodiments of the present disclosure.
Figure 8B:
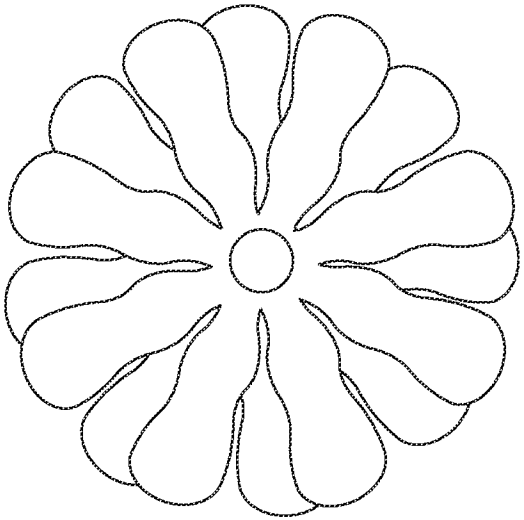
FIG. 8B illustrates exemplary drying panels, according to some embodiments of the present disclosure.
Figure 8A:
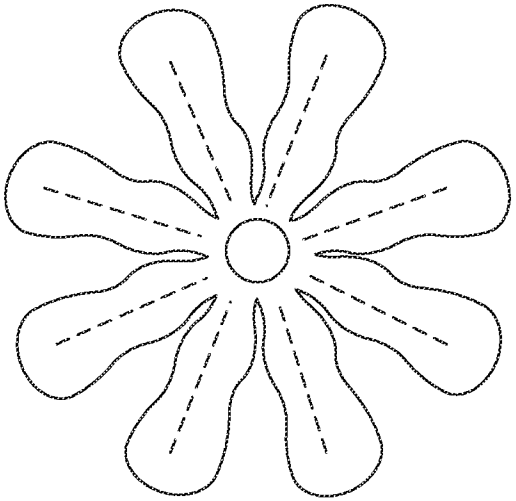
FIG. 8A illustrates exemplary drying panels, according to some embodiments of the present disclosure.
Figure 8D:
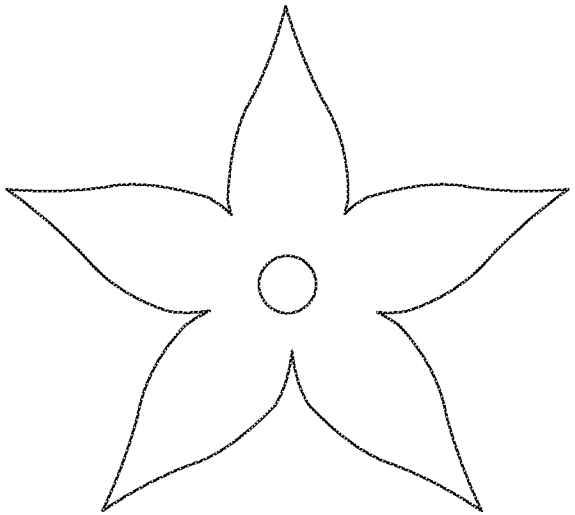
FIG. 8D illustrates exemplary drying panels, according to some embodiments of the present disclosure.
Figure 8C:
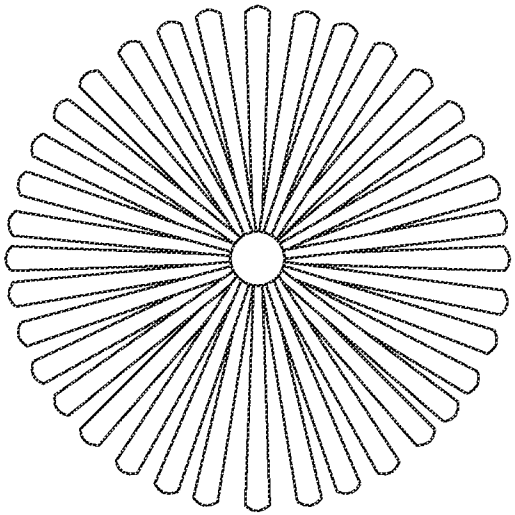
FIG. 8C illustrates exemplary drying panels, according to some embodiments of the present disclosure.
Figure 8E:
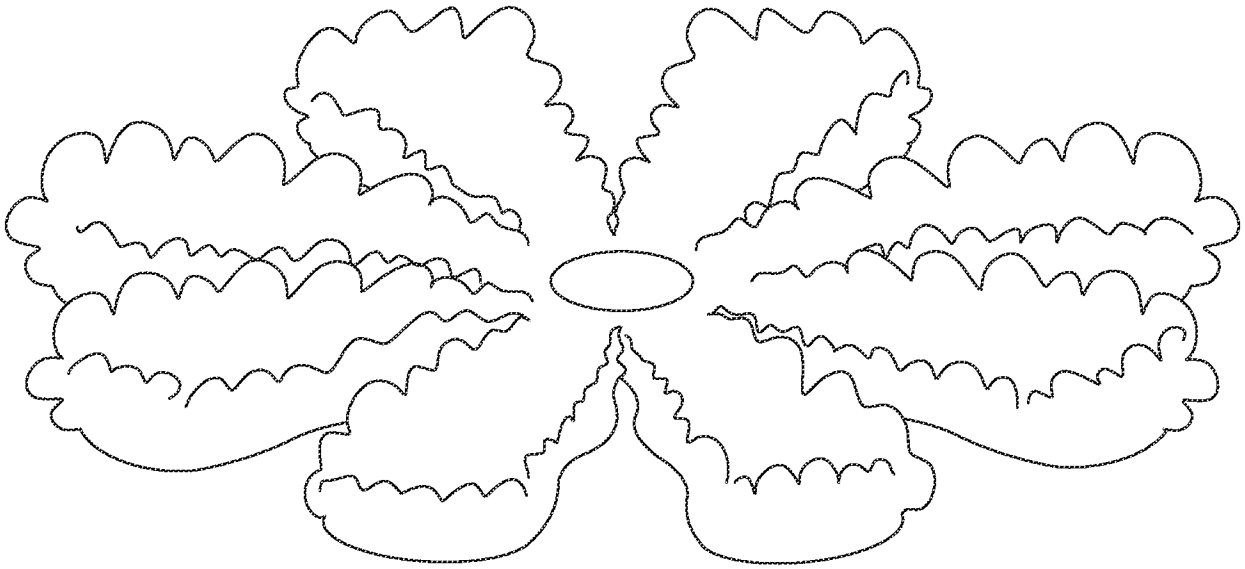
FIG. 8E illustrates exemplary drying panels, according to some embodiments of the present disclosure.

Referring now to FIGS. 7A-B, an exemplary drying mechanism 700 is illustrated. In some embodiments, the drying mechanism 700 may comprise a grip 710. In some implementations, the drying mechanism 700 may comprise a shaft 720 coupled to the grip 710. In some embodiments, the shaft 720 may connect to the neck 730 via an attachment mechanism 725. In some aspects, the neck 730 may comprise a tip 740.

In some aspects, the neck 730 may comprise threaded material, whereby the drying panels 735 of the drying mechanism 700 may be retractable. In some implementations, the retraction may be activated via a retraction mechanism 715. In some aspects, the retraction may be actuated through manual rotation of the neck 730. Through retracting the drying panels 735, the drying mechanism 700 may enter a greater plurality of containers by accessing containers with narrow entry openings. In some embodiments, the retraction mechanism 715 may uniformly or selectively retract the drying panels 735.

In some implementations, the drying material of the drying panels 735 may comprise a plurality of lengths. The predetermined lengths may be adjusted via retraction that allows for drying containers with a plurality of internal surfaces. As an example, the neck 730 of the drying mechanism 700 may retract the drying material for the narrow neck of a flower vase and then the same neck 730 may extend the drying panels 735 to dry the base of a wide mouth thermos, as a non-limiting example.

In some embodiments, the attachment mechanism 725 may comprise a locking mechanism, wherein the tip 740 remains stable with the drying mechanism 700. The locking mechanism may comprise a button, snap-closure, or channel system, as non-limiting examples. In some implementations, the drying mechanism 700 may comprise a plurality of threaded shafts 720, wherein one or more tips 740 may be attached.

Referring now to FIGS. 8A-E, exemplary drying panels 835, 836, 837, 838, 839 are illustrated. In some aspects, the drying panels 835, 836, 837, 838, 839 may comprise one or multiple shapes, sizes, materials, or any combination thereof. The diversity of shapes may be interchanged to improve the drying qualities of the drying mechanism for specific applications. In some implementations, the drying panels 835, 836, 837, 838, 839 may comprise two or more layers of drying panels 838. These layers may allow the drying material to dry a range of containers, which may comprise a plurality of textures, materials, and shapes, as non-limiting characteristics.

In some embodiments, the drying panels 835 may comprise stitching or other non-limiting composites that may provide structural support and rigidity to the drying panels 835, as non-limiting attributes. As an example, the drying panels 835 may comprise a thicker thread that binds layers within the drying panels 835. The thread may be intentionally placed along the center of the drying panels 835 to provide rigidity. This rigidity may allow the drying panels 835 to retain sufficient composition to maneuver into distal regions of a container that may contain moisture. In some implementations, the thread may be placed along the outer edges of the drying panels 835.

In some aspects, the drying panels 835, 836, 837, 838, 839 may comprise a plurality of materials, depending on what kind of liquids need to be absorbed. In some embodiments, the drying panels 838 may be offset and comprise one or more layers. In some aspects, the drying panels 835, 836, 837, 838, 839 may comprise one or more absorbent material, such as synthetic, organic, or natural materials. As a non-limiting example, the drying panels 835, 836, 837, 838, 839 may be texturized to both absorb liquid from and wipe dry a glass container.

For example, a thicker material may be used to absorb larger collections of liquid, whereas a thinner material may be used for less liquid. A plurality of materials may be used to absorb various liquids, such as water, milk, oil, chemicals, and other non-limiting examples.

Figure 9:
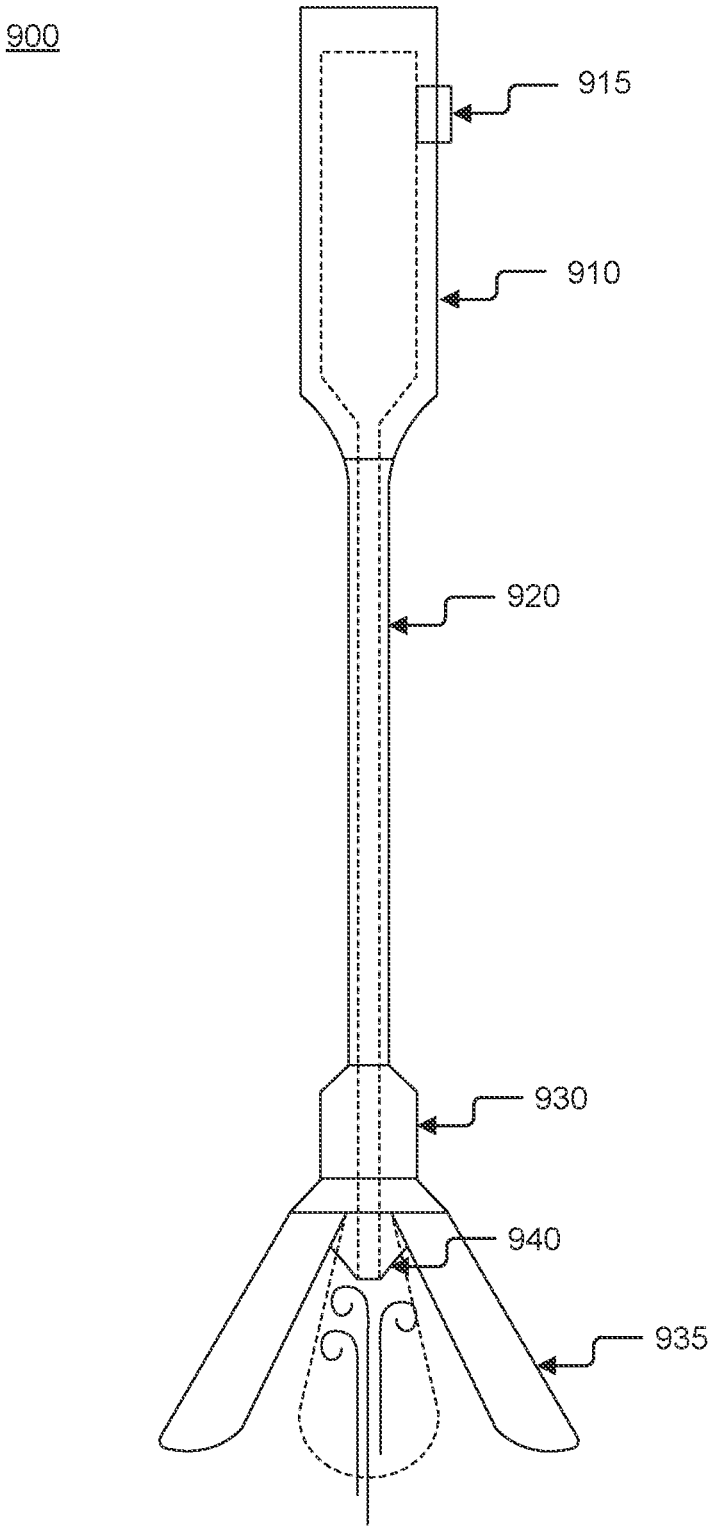
FIG. 9 illustrates an exemplary drying mechanism, according to some embodiments of the present disclosure.

Referring now to FIG. 9, an exemplary drying mechanism 900 is illustrated. In some embodiments, the drying mechanism 900 may comprise a grip 910. In some implementations, the drying mechanism 900 may comprise a shaft 920 coupled to the grip 910. In some aspects, the neck 930 may comprise a plurality of drying panels 935. In some implementations, the neck 930 may comprise a tip 940.

In some embodiments, the drying mechanism 900 may comprise an activation mechanism 915, wherein an airway system is engaged. In some embodiments, the drying mechanism 900 may comprise a hollow interior, wherein the airway system may be located. In some implementations, the airway system may extract fluid through the drying mechanism 900. For example, the drying mechanism 900 may be able to suction fluid from the bottom of a container in addition to absorbing moisture with the plurality of drying panels 935. This may allow for an even drier result than otherwise possible.

In some implementations, the tip 940 may comprise an opening, wherein air may enter the mechanism. In some aspects, the tip 940 may comprise a suction mechanism, wherein moisture may be extracted from a container. In some aspects, the suction mechanism may be activated using an activation mechanism 915 located on the grip 910. In some aspects, the suction mechanism may be directly connected to the tip 940 of the drying mechanism 900. In some embodiments, the suction mechanism may extract remaining liquid within the container that may otherwise overwhelm the drying panels 935 of the drying mechanism 900 and prevent thorough drying of the interior of the container. In some implementations, the suction mechanism may pull fluid toward the drying panels 935, allowing for more effective drying.

In some aspects, the tip 940 may activate the airway opening when the drying panels 935 begin their retraction into the neck 930 of the drying mechanism 900. In some implementations, the shaft 920 may comprise a ball valve, wherein the valve prevents airflow until the tip 940 retracts the drying panels 935 that may otherwise impede airflow from the drying mechanism 900. For example, the airway of the drying mechanism 900 may remain closed while the airway system is inactive, but when the drying material of the drying panels 935 retract to a specific length the airway may then expel air or fluid, as non-limiting examples.

Figure 10:
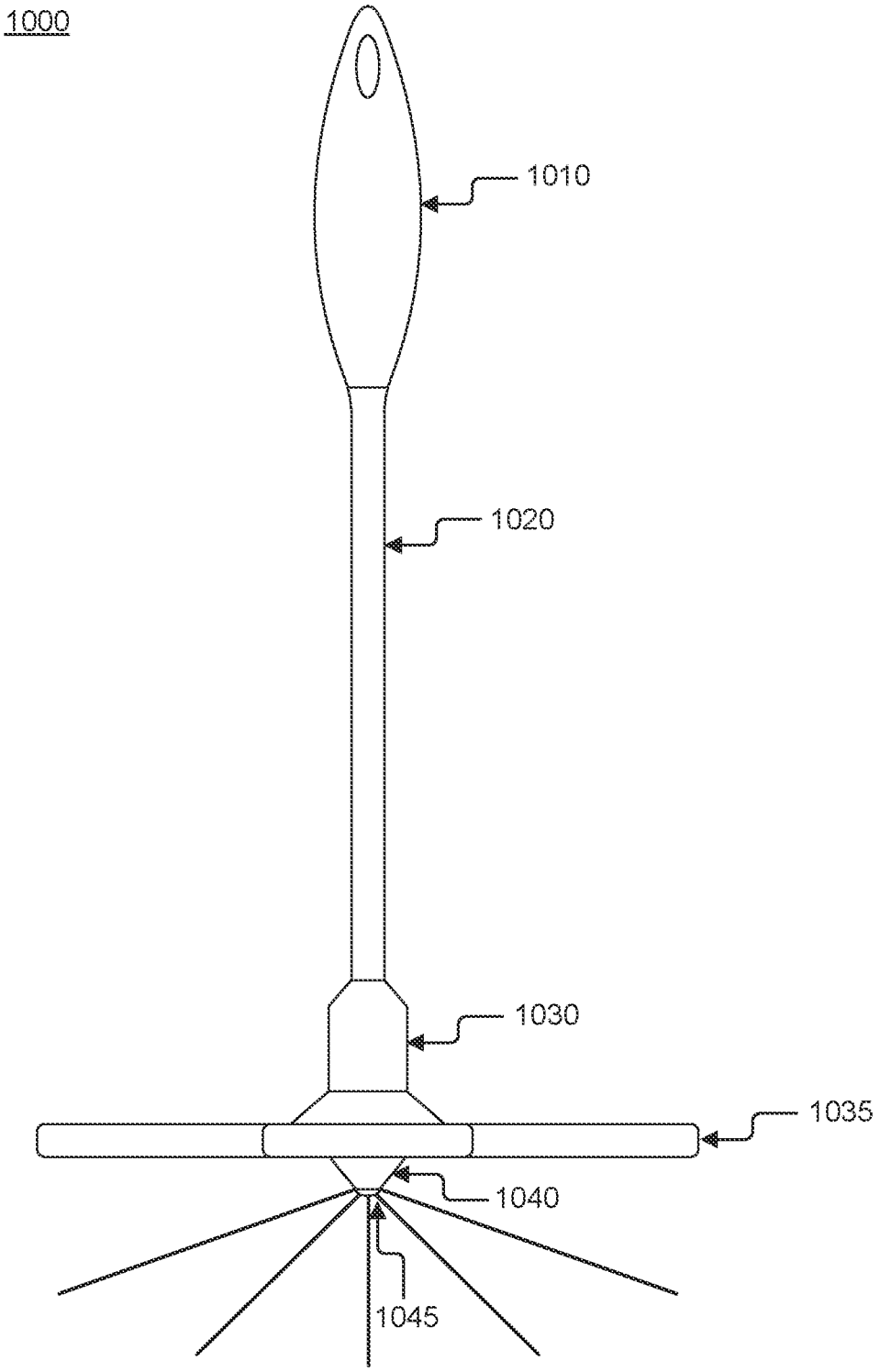
FIG. 10 illustrates an exemplary drying mechanism comprising a sensor, according to some embodiments of the present disclosure.

Referring now to FIG. 10, an exemplary drying mechanism 1000 comprising a sensor 1045 is illustrated. In some embodiments, the drying mechanism 1000 may comprise a grip 1010. In some implementations, the drying mechanism 1000 may comprise a shaft 1020 coupled to the grip 1010.

In some aspects, the neck 1030 may comprise a plurality of drying panels 1035. In some implementations, the neck 1030 may comprise a tip 1040. In some aspects, the tip 1040 may comprise a sensor 1045.

In some embodiments, a light may be used at the end of the drying mechanism 1000, wherein the user may need visual clearance at the bottom of a container or other hard-to-reach areas. In some implementations, a light may be used to aid the sensor in revealing moist areas at the bottom of a container. In some aspects, the sensor 1045 may notify the drying mechanism 1000 of potential moist areas within a container.

For example, the corner of a container may have been missed by manual use of the drying mechanism 1000 and the sensor 1045 may notify the user when the drying mechanism 1000 encounters a moist area. In some embodiments, the drying mechanism 1000 may comprise an audio source, wherein a noise may signal the user to a moist area. The sensor 1045 may be useful if the interior of the container is not visible to the user.

In some implementations, the drying mechanism 1000 may comprise a vibration mechanism, wherein a moist area may indicate the sensor 1045 to trigger the vibration mechanism in the drying mechanism 1000. The vibrations may indicate when the drying mechanism has come into contact with a moist nonvisible surface of the interior of the container, such as an opaque glass or dark surface.

Figure 11:
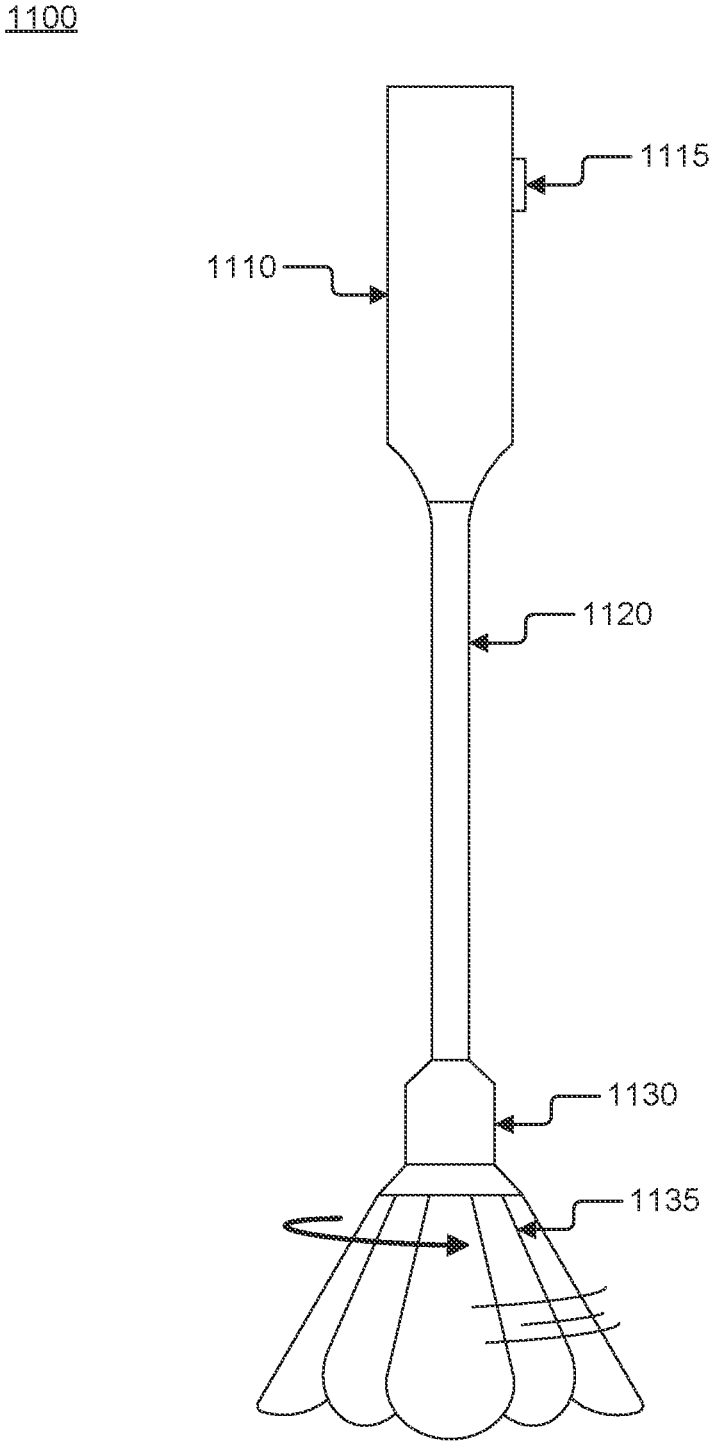
FIG. 11 illustrates an exemplary drying mechanism, according to some embodiments of the present disclosure.

Referring now to FIG. 11, an exemplary drying mechanism 1100 is illustrated. In some embodiments, the drying mechanism 1100 may comprise a grip 1110. In some implementations, the drying mechanism 1100 may comprise a shaft 1120. In some embodiments, the shaft 1120 may connect to the neck 1130 via an attachment mechanism. In some implementations, the neck 1130 may comprise a tip. In some embodiments, the neck 1130 may comprise a plurality of drying panels 1135.

In some aspects, the drying mechanism 1100 may comprise a rotation mechanism 1115 that allows the neck 1130 to rotate. In some embodiments, the neck 1130 may rotate to accentuate the drying panels 1135. In some implementations, the grip 1110 may comprise the rotation mechanism 1115, wherein the rotation of the neck 1130 is activated by pressing or pulling it. In some aspects, the rotation mechanism 1115 may allow for manual control of the drying mechanism 1100 to ensure thorough drying of the container.

In some implementations, the rotation mechanism 1115 may comprise a speed adjustment mechanism, wherein the speed of the drying mechanism 1100 varies. In some aspects, the speed of the drying mechanism 1100 may be adjusted incrementally or freely according to user customization. In some embodiments, rotation may be mechanically activated. As an example, a ripcord may protrude from the grip of the drying mechanism, thereby allowing for manual rotation of the drying panels 1135. In some aspects, rotation may be automatic and the drying mechanism 1100 may require a power source, such as a disposable or rechargeable battery, as non-limiting examples.

Figure 12:
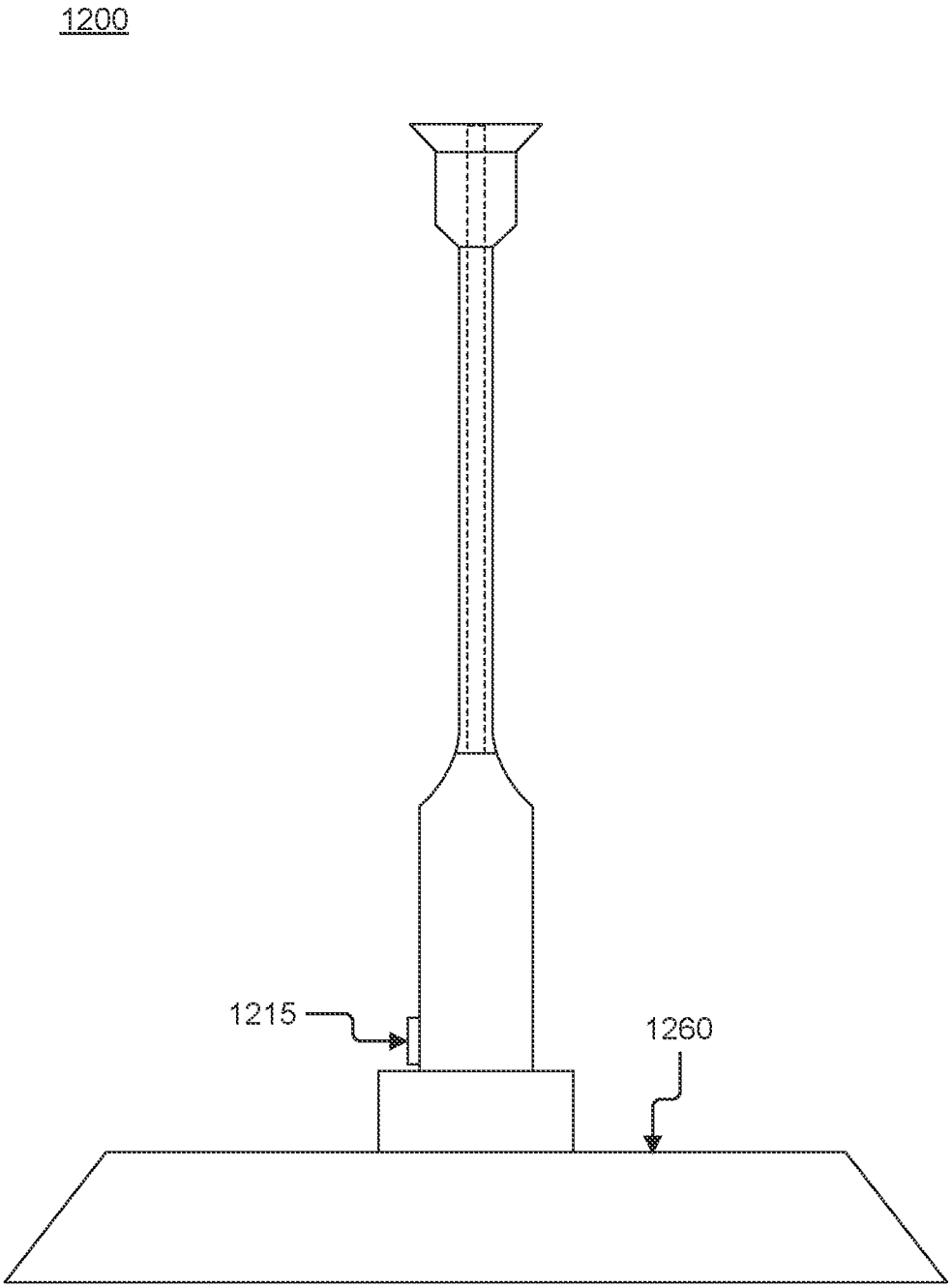
FIG. 12 illustrates an exemplary drying mechanism, according to some embodiments of the present disclosure.

Referring now to FIG. 12, an exemplary drying mechanism 1200 is illustrated. In some embodiments, the external device 1260 may act as a charging stand for the drying mechanism 1200. In some aspects, the drying mechanism 1200 may interface with an external device 1260 that may provide power to the drying mechanism 1200. In some embodiments, the external device 1260 may comprise a port, wherein the drying mechanism 1200 may be charged. In some aspects, the external device 1260 may comprise a light, whereby it notifies of the drying mechanism 1200 being fully charged. In some embodiments, the drying mechanism 1200 may comprise a locking mechanism 1215 to attach the drying mechanism 1200 to the external device 1260.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular or sequential order shown to achieve desirable results. In certain implementations, multitasking and parallel processing may be advantageous. Nevertheless, it will be understood that various modifications may be made without departing from the spirit and scope of the claimed disclosure.

What is claimed is:

1. A portable drying mechanism comprising:

a grip configured to allow for gripping by a hand, wherein the grip comprises a first grip end and a second grip end;

a shaft comprising a first shaft end and a second shaft end, wherein the first shaft end is couplable to the second grip end;

a neck comprising:

a first neck end, wherein the first neck end is couplable to the second shaft end, a second neck end, and a plurality of drying panels configured to extend from the second neck end, wherein each of the plurality of drying panels comprises a distal end, wherein distal ends of adjacent drying panels are physically separate, wherein each drying panel further comprises at least one rigidity enhancing element physically integrated with each drying panel, wherein the at least one rigidity enhancing element is configured to make each drying panel more rigid;

a tip comprising a first tip end and a second tip end, wherein the first tip end is couplable to the second neck end, wherein the tip comprises a substantially frusto-conical shape, wherein none of the plurality of drying panels extend from the second tip end; and an attachment mechanism configured to couple the neck to one or both the second neck end and the first tip end.

2. The portable drying mechanism of claim 1, wherein the attachment mechanism comprises one or more of a threaded connection, a bayonet coupling, a snap-in-place mechanism, a sliding mechanism, and a button mechanism.

3. The portable drying mechanism of claim 1, wherein the shaft is flexible.

4. The portable drying mechanism of claim 1, wherein a length of the shaft is adjustable.

5. The portable drying mechanism of claim 1, wherein the shaft comprises a telescoping mechanism.

6. The portable drying mechanism of claim 1, wherein the shaft comprises multiple pieces that integrate to extend or compress a length of the shaft incrementally.

7. The portable drying mechanism of claim 1, wherein the second tip end comprises a sensor.

8. The portable drying mechanism of claim 1, wherein one or more of the grip, shaft, neck, and tip are hollow.

9. The portable drying mechanism of claim 1, wherein the plurality of drying panels is replaceable.

10. The portable drying mechanism of claim 1, wherein the plurality of drying panels is retractable.

11. The portable drying mechanism of claim 1, wherein the plurality of drying panels is reusable.

12. The portable drying mechanism of claim 1, wherein the neck comprises a flexible portion configured to allow the shaft to bend.

13. The portable drying mechanism of claim 1, wherein the plurality of drying panels is flexible.

14. The portable drying mechanism of claim 1, wherein the shaft is interchangeable.

15. The portable drying mechanism of claim 1, further comprising a rotation mechanism, wherein rotation of the plurality of drying panels is configured to be automated or manually manipulated.

16. The portable drying mechanism of claim 1, comprising a release mechanism configured to release the attachment mechanism.

17. The portable drying mechanism of claim 1, wherein the portable drying mechanism is wholly or partly reusable.

18. The portable drying mechanism of claim 1, wherein the plurality of drying panels is detachable and replaceable.

19. The portable drying mechanism of claim 1, wherein each of the plurality of drying panels comprises an actinomorphic shape.

20. The portable drying mechanism of claim 1, wherein the at least one rigidity enhancing element comprises one or more stitches.

* * * * *